United States Patent [19]

DiLiddo et al.

[11] 4,109,376

[45] Aug. 29, 1978

[54] METHOD OF MANUFACTURING A CIRCUIT BREAKER ASSEMBLY OR THE LIKE

[75] Inventors: Ronald C. DiLiddo, Kettering; Dallas E. King, Dayton, both of Ohio

[73] Assignee: General Motors Corporation, Detroit, Mich.

[21] Appl. No.: 809,565

[22] Filed: Jun. 24, 1977

[51] Int. Cl.[2] ..... H01H 11/00

[52] U.S. Cl. ..... 29/622; 29/418; 29/628; 337/231

[58] Field of Search ..... 29/418, 469, 621, 622, 29/623, 628; 337/231, 232, 251, 252; 113/119

[56] References Cited

U.S. PATENT DOCUMENTS

| | | | |
|---|---|---|---|
| 2,433,384 | 12/1947 | McLarn | 29/628 |
| 3,442,004 | 5/1969 | Schink | 29/418 |
| 3,561,113 | 2/1971 | Burke | 29/418 |
| 3,882,438 | 5/1975 | Bourner | 337/231 |

*Primary Examiner*—Lowell A. Larson
*Attorney, Agent, or Firm*—F. J. Fodale

[57] ABSTRACT

A circuit breaker assembly includes a subassembly comprising a circuit breaker and a one piece terminal which is severed to provide two separate terminal pieces after the subassembly is secured in the housing. In a second circuit breaker assembly the one piece terminal forming part of the subassembly is severed at three places to provide three separate terminal pieces.

5 Claims, 6 Drawing Figures

METHOD OF MANUFACTURING A CIRCUIT BREAKER ASSEMBLY OR THE LIKE

Figure 1:
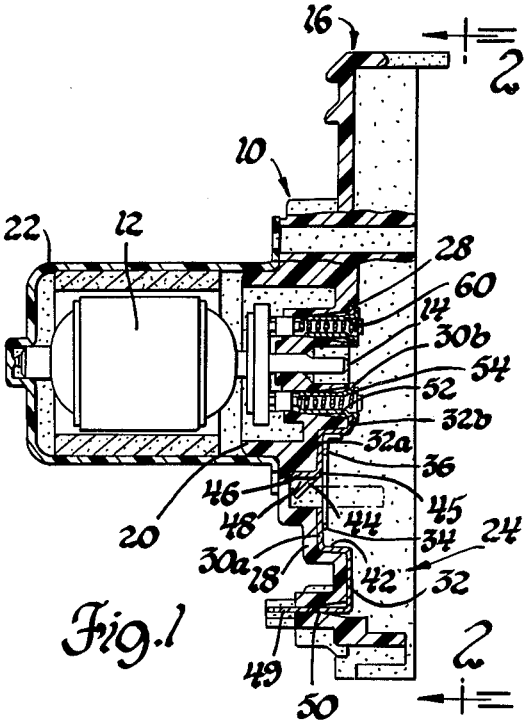

This invention relates generally to a method of making a circuit breaker assembly or the like and more particularly to the method of making a circuit breaker assembly or the like designed for automated assembly.

By way of background, passenger cars today often include remotely controlled electrically driven door locks, windows and other apparatus. Such devices comprise an electric motor which provides the motive power to a mechanical actuator which is mechanically linked to the remotely controlled apparatus and also generally include a circuit breaker to protect the electric motor from overload in the event that the actuator or remotely controlled apparatus will not respond for one reason or another. A typical commercially available circuit breaker is one which is self contained in a glass sealed envelope provided with two protruding wire leads for permanent attachment to separate terminal pieces. Such circuit breakers are somewhat fragile and often placed in a protective position in a deep cavity in an insulative housing.

In developing a door lock actuator designed for automated assembly, a major problem was encountered in designing the circuit breaker assembly which includes a set of terminals for connection to the power leads from the switch and a second set of terminals for connection to the brushes of a reversible direct current motor. The problem concerned permanently securing the wire leads of the circuit breaker to separate terminals. The flexibility of the wire leads did not allow the circuit breaker and separate terminals to be formed into a subassembly which was stable enough to handle and feed for subsequent assembly to the housing. On the other hand the welding operation which permanently secured the wire leads to the separate terminals could not be performed if the two terminals were first assembled to the housing because the housing was designed with a deep cavity to receive and protect the circuit breaker.

This invention solves this major problem by a unique manufacturing method in which the two terminals are originally a single rigid piece to which the circuit breaker can be permanently attached resulting in a subassembly which can be easily handled and assembled to the circuit breaker housing, by automated equipment. Once the subassembly is secured in place a conveniently located severable web of the single piece terminal is cut to provide the two separate terminal pieces needed for the proper circuitry. This method of manufacture also simplifies tooling and results in further cost savings in that one terminal instead of two differently configured terminals is required.

In a further development in connection with another type of actuator it was found that a third terminal required for the proper circuitry could also be integrated into the one piece terminal forming part of the subassembly piece thereby eliminating yet another component which previously had to be separately manufactured, oriented and assembled to the circuit breaker assembly.

Figure 2:
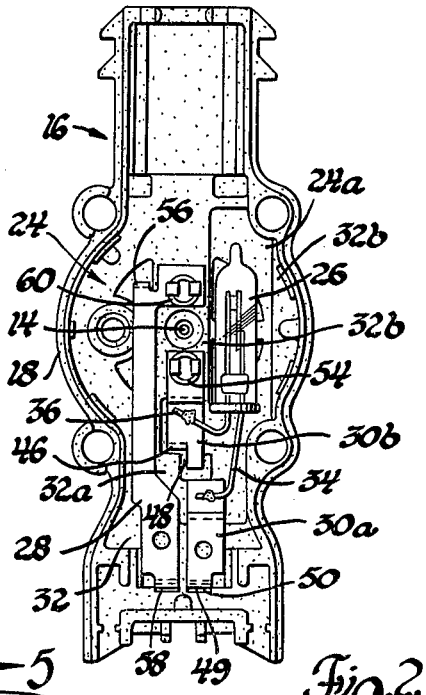
Figure 3:
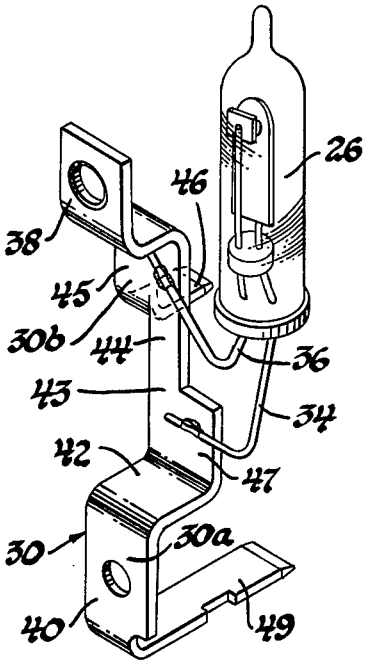
Figure 4:
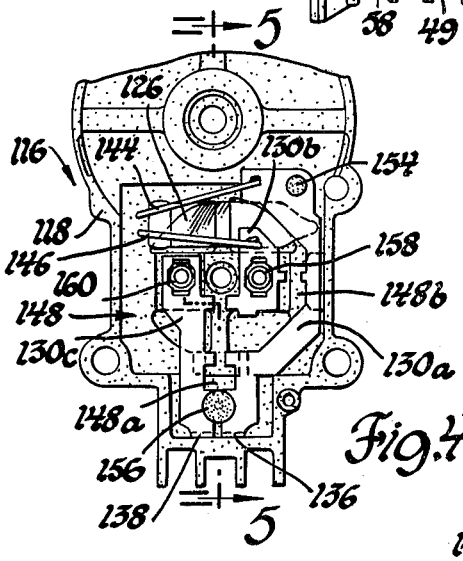
Figure 5:
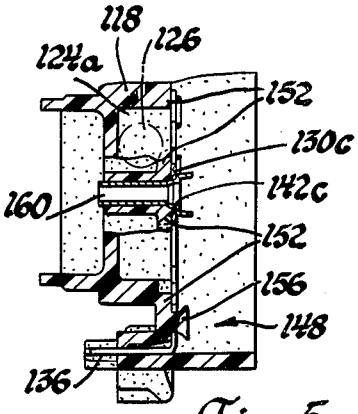
Figure 6:
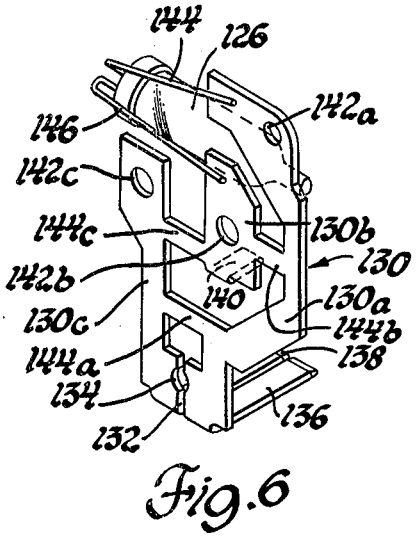

Other objects and features of the invention will become apparent to those skilled in the art as the disclosure is made in the following detailed description of two circuit breaker assemblies made by different methods within the scope of the invention as illustrated in the accompanying sheet of drawing in which:

FIG. 1 is a side sectional view of an electric motor assembly which includes a circuit breaker assembly made by a method in accordance with this invention, FIG. 2 is a front view of the assembly shown in FIG. 1, FIG. 3 is a perspective view of a subassembly which provides various components for the circuit breaker assembly shown in FIGS. 1 and 2, FIG. 4 is a fragmentary front view of another circuit breaker assembly made by another method in accordance with this invention, FIG. 5 is a side sectional view taken substantially along the line 5—5 of FIG. 4 looking in the direction of the arrows, FIG. 6 is a perspective view of a subassembly which provides various components for the circuit breaker assembly shown in FIGS. 5 and 6.

Referring now to the drawing and more particularly to FIG. 1, there is shown an electric motor assembly 10 which provides the motive power for a mechanical device such as an automotive door lock actuator (not shown). The electric motor assembly includes a reversible direct current motor 12 having an output shaft 14 which is adapted to be mechanically coupled to the actuator for selectively driving the actuator in a forward or reverse direction to lock or unlock the door. The motor is controlled by a three-position switch (forward, off and reverse) usually located on the door panel inside the passenger compartment. This invention is particularly concerned with the method of making the circuit breaker assembly 16 which makes the electrical connection between the electric power leads from the switch (not shown) and the motor 12.

More particularly the circuit breaker assembly 16 comprises a molded plastic housing 18 which is adapted to fit onto the open end of the actuator housing (not shown) and which has a central hub 20 on which is fitted the casing 22 for the electric motor 12.

The housing 18 has an irregularly shaped cavity 24 which houses a circuit breaker 26 and a plurality of terminal pieces 28, **30*a* and 30*b*. The cavity 24 is in part defined by a bi-level shelf 32 which supports various portions of the terminal pieces 28, 30*a* and 30*b*. The bi-level shelf 32 comprises lower level shelf portions 32*a* and upper level shelf portions 32*b***.

The circuit breaker 26 is self contained in a sealed glass envelope with two wire like leads 34 and 36 which are welded or otherwise permanently secured to the terminal pieces **30*a* and 30*b*. For protection, the circuit breaker 26 is disposed in a deep portion 24*a* of the cavity below upper level shelf portions 32*b* substantially surrounding the glass envelope. Consequently it is difficult to weld the wire like leads 34 and 36 to the terminal pieces 30*a* and 30*b* if the terminal pieces are first mounted on the bi-level shelf 32. On the other hand, if the circuit breaker leads 34 and 36 are first welded to the terminal pieces 30*a* and 30*b*, the resulting subassembly is difficult to handle and assemble to the housing 18**. This invention is directed to a unique assembly method which overcomes the above difficulties.

Referring now to FIG. 3, there is disclosed a two piece subassembly comprising a unitary terminal 30 and the circuit breaker 26. The terminal 30 has coplanar apertured ends 38 and 40 connected by a generally U-shaped mid portion 42 having a flat bottom 43 which includes a narrow severable web 44. The bottom portion 45 between the web 44 and the end 38 has a perpendicular stabilizer tab 46 integrally connected to it. The end 40 has a perpendicular male blade 49 integrally connected to it.

During assembly, the leads 34 and 36 are first welded or otherwise permanently secured to the respective bottom portions 45 and 47 on opposite sides of the severable web 44. This subassembly is then inserted into the housing 16 placing the terminal 30 on the bi-level shelf 32 and the circuit breaker 26 in the deep portion 24*a* of the cavity 24 where it is below and protected by upper level shelf portions 32*b*. The tab 46 is disposed in an irregular slot 48 and the male blade 48 extends through a through cavity 50 to aid in properly locating the web 44 over a portion of the slot 48. The tip of the male blade 49 is exposed for electrical connection to one of the power leads from the switch (not shown).

The terminal 30 is preferably bonded in the proper position where the bottom portions 45 and 47 rest on the lower level shelf portions 32*a* and the aperture in the terminal end 38 aligns with a tapered bore 52 in the central hub 20 of the housing 18. The terminal end 38 is further secured by a conductive flanged eyelet 54 force fitted into the bore 52. Once secured, the web 44 is severed and bent downwardly into the slot 48 by the tool shown in phantom in FIG. 1. This separates the terminal 30 into terminal pieces 30*a* and 30*b* which are individually secured to the housing.

The other terminal 28 is generally planar and apertured at each end. A small perpendicular tab 56 is integral with one end and a perpendicular male blade 58 is integral with the opposite end. The tab 56 and blade 58 aid in properly locating the terminal 28 which is also preferably bonded in position either before or after the terminal 30 is severed into two pieces. The apertured end adjacent the small tab 56 is further secured to the housing 16 by a second conductive flanged eyelet 60. The terminal 28, however, remains in one piece.

In its operating environment the male blade 49 is connected to one of the power leads from the switch (not shown) for establishing a conductive path to the brushes for the motor 12 via terminal piece 30*a*, circuit breaker 26 and terminal piece 30*b* which are arranged in series. The male blade 58 is connected to the other power lead from the switch (not shown) for establishing a second conductive path to the other brush of motor 12 via the terminal 28 and eyelet 60. The motor 12 is driven in the forward direction by moving the switch from "off" to "forward". It is driven in the reverse direction by moving the switch from "off" to "reverse" which reverses the polarity at the male blades 49 and 58.

The circuit breaker assembly 116 shown in FIGS. 4, 5 and 6 is made by a further improved method which reduces the number of terminal pieces which have to be handled during assembly. The terminal 130 used in this assembly is shown in FIG. 6 and ultimately forms three terminal pieces 130*a*, 130*b* and 130*c*.

More particularly, the terminal 130 is generally flat and comprises two elongated generally parallel side portions 130*a* and 130*c* and a short mid portion 130*b* interposed between the upper ends of the side portions. The lower ends of the side portions 130*a* and 130*c* are juxtaposed and connected to each other by a web 144*a* and cooperatively form a slot 132 having an enlarged circular center 134. The short mid portion 130*b* is connected to the side portions 130*a* and 130*c* by web portions 144*b* and 144*c* respectively. The lower ends of the side portions 130*a* and 130*c* have perpendicular male blades 136 and 138 respectively while the lower end of the mid portion 130*b* has a perpendicular locating tab 140. The portions 130*a*, 130*b* and 130*c* have apertures 142*a*, 142*b* and 142*c* respectively. The circuit breaker 126 again is self contained in a sealed glass envelope and has wire like leads 144 and 146 which are respectively welded or otherwise permanently secured to the spaced upper ends of the side portions 130*a* and 130*b* of the terminal 130 to first form a subassembly.

The subassembly which is shown in FIG. 6 is then inserted into cavity 148 of a molded plastic housing 118 and located in the proper position where the coplanar portions 130*a* 130*b* and 130*c* rest on shelf portions 152 partly defining the cavity and the circuit breaker 120 is disposed in a deep portion 124*a* of the cavity below juxtaposed shelf portions 152. The male blades 136, 138 are disposed in through cavities exposing their tips for connection to electric power leads from a three-position switch (not shown). The tab 140, male blades 136, 138 aid in properly locating the terminal together with the aperture 142*a* and slot center 134 which respectively receive integral studs 154 and 156 of the housing 118. The terminal 130 is preferably bonded in place and then further secured by heat staking the studs 154, 156 and force fitting flanged eyelets 158, 160 into housing bores aligned with the terminal apertures 142*b* and 142*c* respectively. In the secured position, the webs 144*a* and 144*c* both overlie a common slot 148*a* and the web 144*b* overlies a slot 148*b*. The webs are then severed and bent downwardly into the slots to form three separate terminal pieces 130*a*, 130*b* and 130*c*. The circuit breaker assembly then provides a first conductive path from the male blade 136 to the eyelet 158 via the integral terminal piece 130*a*, circuit breaker 144 and terminal piece 130*b* arranged in series and a second conductive path from the male blade 138 to the eyelet 160 via the integral terminal piece 130*c*. As in the previous embodiment the eyelets and male blades are ultimately electrically connected to the motor brushes and power leads respectively.

We wish it to be understood that we do not desire to be limited to the exact details of construction shown and described, for obvious modifications will occur to a person skilled in the art.

We claim:

1. The method of making a circuit breaker assembly or the like comprising the steps of:

providing an insulator housing having a cavity defined in part by shelf means and a slot, providing a one piece sheet metal terminal shaped to include spaced portions adapted to rest on spaced locations of the shelf means located across the slot from each other and a severable web between said spaced portions, providing an electrical device which fits in a portion of the cavity deeper than the cavity portions defined by the shelf means and which has a pair of wire like leads, forming a subassembly by permanently securing the pair of wire like leads to respective portions of the terminal located on opposite sides of the thin severable web from each other, securing the subassembly in the cavity of the insulator housing with the terminal supported on the shelf means and the severable web overlying the slot, and severing the web and bending at least a portion thereof downwardly into the slot to separate the terminal into two terminal pieces and provide a conductive path comprising one of the terminal pieces, the electrical device and the other of the terminal pieces in a series arrangement.

2. The method of making a circuit breaker assembly or the like comprising the steps of:

providing an insulator body having a cavity therein defined in part by shelf means and a slot, providing a one piece sheet metal terminal shaped to include an apertured portion and another portion spaced therefrom adapted to rest on spaced locations of the shelf means located across the slot from each other, a severable web between said apertured portion and said another portion and a male blade integrally connected to said another portion, providing an electrical device which fits in a protected portion of the cavity deeper than juxtaposed shelf means partly defining the cavity and which has a pair of wire like leads, forming a subassembly by permanently securing the pair of wire like leads to respective portions of the terminal located on opposite sides of the severable web from each other, securing the subassembly in the cavity of the insulator housing with the apertured portion of the terminal secured on the shelf means by a conductive member, the another portion of the terminal supported on the shelf means and the severable web overlying the slot, and severing the web and bending at least a portion thereof downwardly into the slot to separate the terminal into a first terminal piece including the apertured portion and a second terminal piece integrally connected to the male blade and provide a conductive path comprising the first terminal piece, the electrical device and the second terminal piece in a series arrangement.

3. The method of making a circuit breaker assembly or the like comprising the steps of:

providing an insulator body having a cavity therein defined in part by shelf means and a slot, providing a one piece sheet metal terminal shaped to include an apertured portion and another portion spaced therefrom adapted to rest on spaced locations of the shelf means located across the slot from each other, a severable web between said spaced portions and a male blade integrally connected to the another portion, providing an electrical device comprising a fragile self contained unit which fits in a protected portion of the cavity below juxtaposed portions of the shelf means partly defining the cavity and which has a pair of wire like leads, forming a subassembly by permanently securing the pair of wire like leads to respective portions of the terminal located on opposite sides of the severable web from each other, securing the subassembly in the cavity of the insulator housing with the apertured portion of the terminal secured on the shelf means and engaging a conductive member disposed in a bore of the housing, the another portion of the terminal supported on the shelf means and the thin severable web overlying the slot, and severing the web and bending at least a portion thereof downwardly into the slot to separate the terminal into a first terminal piece including the apertured portion and a second terminal piece integrally connected to the male blade and provide a conductive path comprising the first terminal piece, the electrical device and the second terminal piece in a series arrangement.

4. The method of making a circuit breaker assembly or the like comprising the steps of:

providing an insulator housing having a cavity defined in part by upper and lower shelf means and a slot interrupting a portion of the lower shelf means, providing a one piece sheet metal terminal having a U-shaped mid portion shaped to include spaced portions adapted to rest on spaced locations of the lower shelf means located across the slot from each other and a narrow severable web between said spaced portions, providing an electrical device which fits in a protected portion of the cavity deeper than the cavity portions defined by the shelf means and which has a pair of wire like leads, forming a subassembly by permanently securing the pair of wire like leads to the spaced portions of the terminal so that the leads are located on opposite sides of the severable web from each other, securing the subassembly in the cavity of the insulator housing with the terminal supported on the upper and lower shelf means and the thin severable web overlying the slot, and severing the web and bending at least a portion thereof downwardly into the slot to separate the terminal into two terminal pieces and provide a conductive path comprising one of the terminal pieces, the electrical device and the other of the terminal pieces in a series arrangement.

5. The method of making a circuit breaker assembly or the like comprising the steps of:

providing an insulator housing having a cavity defined in part by shelf means and slot means, providing a one piece sheet metal terminal shaped to include first, second and third portions spaced from and connected to each other by three thin severable webs and so that the first, second and third portions are adapted to rest on spaced locations of the shelf means with each of the three severable webs overlying the slot means, providing an electrical device which fits in a portion of the cavity deeper than the cavity portions defined by the shelf means and which has a pair of wire like leads, forming a subassembly by permanently securing the pair of wire like leads respectively to the first and second portions of the terminal so that the leads are located on opposite sides of one of the three thin severable webs from each other, securing the subassembly in the cavity of the insulator housing with the terminal supported on the shelf means and the three thin severable webs overlying the slot means, and severing the webs and bending at least a portion of each downwardly into the slot means to separate the first, second and third terminal portions into first, second and third terminal pieces respectively and provide a first conductive path comprising the first terminal piece, the electrical device and the second terminal piece in a series arrangement and a second conductive path comprising the third terminal piece.

* * * * *